US008083409B2

(12) United States Patent
Gelbard

(10) Patent No.: US 8,083,409 B2
(45) Date of Patent: Dec. 27, 2011

(54) BAG WITH INTEGRAL FLAPS FOR TYING ABOVE THE BAG

(76) Inventor: Edward S. Gelbard, Knightsbridge (GB)

( * ) Notice: Subject to any disclaimer, the term of this patent is extended or adjusted under 35 U.S.C. 154(b) by 520 days.

(21) Appl. No.: 11/720,096

(22) PCT Filed: Nov. 24, 2005

(86) PCT No.: PCT/GB2005/004517

§ 371 (c)(1),
(2), (4) Date: Aug. 13, 2008

(87) PCT Pub. No.: WO2006/056784

PCT Pub. Date: Jun. 1, 2006

(65) Prior Publication Data

US 2009/0004414 A1 Jan. 1, 2009

(30) Foreign Application Priority Data

Nov. 24, 2004 (GB) ..... 0425844.8

(51) Int. Cl.
*B65D 33/08* (2006.01)
*B65D 33/10* (2006.01)

(52) U.S. Cl. ..... 383/10; 383/77

(58) Field of Classification Search ..... 428/35.5; 383/10, 77, 9

See application file for complete search history.

(56) References Cited

U.S. PATENT DOCUMENTS

| | | | | |
|---|---|---|---|---|
| 3,402,749 | A * | 9/1968 | Kinzler | 383/10 |
| 3,462,069 | A * | 8/1969 | Suominen | 383/10 |
| 4,759,639 | A * | 7/1988 | DeMatteis | 383/7 |
| 5,720,557 | A | 2/1998 | Simonsen | |
| 5,908,244 | A * | 6/1999 | Galambos | 383/8 |
| 6,231,232 | B1 | 5/2001 | Warr | |
| 2002/0020648 | A1 | 2/2002 | Lam et al. | |

FOREIGN PATENT DOCUMENTS

| | | |
|---|---|---|
| DE | 877 16 803 | 2/1988 |
| DE | 201 18 417 | 2/2002 |
| DE | 2 021 9944 | 4/2003 |
| EP | 0 341 739 | 11/1989 |
| EP | 0 541 028 | 5/1993 |
| FR | 2 632 274 | 12/1989 |
| GB | 2 208 843 | 4/1989 |
| JP | 10 338302 | 12/1998 |

OTHER PUBLICATIONS

Search Report Issued by the United Kingdom Patent Office for Application No. GB0523943.9, Jan. 2006.

International Search Report for PCT Application No. PCT/GB2005/0004517; Filed Nov. 24, 2005; Date of Completion Mar. 3, 2006; Date of Mailing Mar. 16, 2006.

(Continued)

*Primary Examiner* — Alexander Thomas
(74) *Attorney, Agent, or Firm* — Alston & Bird LLP

(57) ABSTRACT

A bag comprising an elongate body (12) having a closed end (14) and an open end defining the mouth of the bag (16), wherein the body is provided with a pair of integral elongate protrusions (18) that extend away from the body so that the protrusions can be tied together to close the mouth of the bag. The protrusion may have at least one aperture (20) therein. In a preferred embodiment, the protrusions can be tied with a double knot. A roll of material defining a plurality of the aforesaid bags. A method of providing a roll of the aforesaid bags.

15 Claims, 4 Drawing Sheets

OTHER PUBLICATIONS

Figure 1:
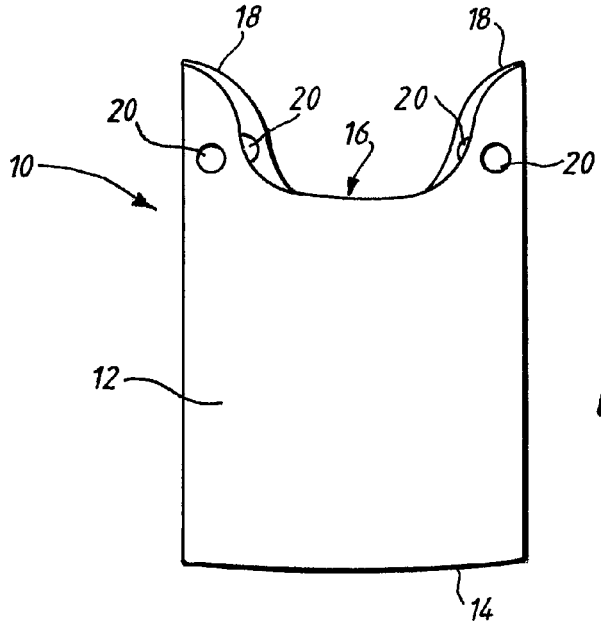

Written Opinion for PCT Application No. PCT/GB2005/0004517; Filed Nov. 24, 2005; Date of Completion Mar. 3, 2006; Date of Mailing Mar. 16, 2006.

International Preliminary Report on Patentability for PCT Application No. PCT/GB2005/0004517; Filed Nov. 24, 2005 (Includes Amended Sheets of the Specification and Claims).

* cited by examiner

BAG WITH INTEGRAL FLAPS FOR TYING ABOVE THE BAG

The present invention relates to a bag, and in particular to a bag, such as a bin liner, for storing refuse, or a food storage bag.

A known refuse bag is typically rectangular in shape, and is conveniently closed before transporting the bag to a collection point. The bag may be closed by use of a discrete tie, usually made of wire. However, the use of a discrete tie can be cumbersome, especially if the bag has been loaded to capacity, and can result in the tie being difficult to apply and/or male the bag difficult to carry.

To overcome the disadvantages of the above-mentioned bag, several types of designs have been devised. One such design includes a tie integral with the bag, the tie being in the form of "four shallow ears" or protrusions that extend from the body, the ears being arranged so that they have to be tied in a knot to close the bag. However, it can be difficult to tie and difficult to carry such a bag when it is heavily laden.

Another known design of bag incorporates a draw-tape around the mouth of the bag. Once the bag is full, the draw-tape is pulled to close the mouth of the bag, and the bag can be lifted and transported by the loop created by the draw-tape after it is pulled. However, this type of bag is more difficult to mass produce, and results in an expensive refuse bag and the tape is prone to failure.

According to a first aspect of the present invention there is provided a bag comprising an elongate body having a closed end defining a bottom of the bag and an open end defining a mouth of the bag and wherein the body is provided with a pair of integral elongate protrusions that extend away from the body, the pair of elongate protrusions being arranged such that they can be tied together to close the mouth of the bag.

Advantageously, each protrusion has at least one aperture therein. Preferably, each aperture is created so as to provide a handle.

The present invention, therefore, provides a refuse bag with handles, the design of which can be easily tied and carried. The bag can be easily mass-produced resulting in no material wastage to produce the handles.

The apertures may be created by a punch so as create cut-outs. The punch may allow the cut-outs to be fully removed. Alternatively, the punch may be designed to leave a portion of each cut-out connected to its protrusion, so as to form an "upside-down cut-out". The feature of an "upside-down cut-out" reduces the possibility of tear propagation when a loaded bag is lifted.

By "upside down cut-out" it is meant that the material is punched to form a cut-out where at least some of the material closest to the body of the bag is not penetrated or weakened, so that the material of the cut-out remains connected to the protrusion.

Preferably, but not exclusively, each aperture is located in a portion of the respective protrusion close to the body of the bag. Providing the apertures in these locations maximises the material above the apertures, and thereby maximises the strength of the elongate protrusions when they are used as a handle for lifting or carrying the bag.

Preferably, each protrusion is provided with a plurality of apertures formed therein. This provides the advantage that the weight of the bag, when loaded, is distributed over the material surrounding the apertures. Therefore, within reason, the more apertures that are provided in the protrusions the greater the lift capacity of the bag will be.

Preferably, the elongate protrusions are curved in shape, and preferably extend sufficiently from the body to allow a single cross-over of the protrusions to form a hitch to close the mouth of the bag, or a double cross-over to form a simple knot, to prevent any articles from falling out of the bag.

Preferably, the bag is made from a thermoplastics material such as polyethylene. The polyethylene material may be high, medium, low or linear low density or any blend of thermoplastics material.

Preferably, the closed end of the bag is formed by heat sealing.

According to a second aspect of the present invention, there is provided a roll of material defining a plurality of bags, each bag comprising an elongate body having a closed end defining a bottom of that bag and an open end defining a mouth of that bag, and wherein the body of each bag is provided with a pair of integral elongate protrusions that extend away from that body, each bag being formed so as to be separable from the roll.

Each elongate protrusion may have at least one aperture formed therein. Preferably, each aperture is defined by a cut-out. In a preferred embodiment, the cut-out is an "upside-down cut-out". The at least one aperture may be formed by removal of material.

Preferably, the material of the roll is a thermoplastics material, for example polyethylene. The polyethylene material may be high, medium, low or linear low density or any blend of thermoplastics material.

Preferably, the closed end of each bag is created by heat sealing across the width of the material.

The material may be provided with a respective first weakened line adjacent to the closed end of each bag to enable that bag to be separated from the next bag on the roll.

An open end of each bag may be provided with a second weakened line defining elongate protrusions extending away from the body of that bag.

The first and second weakened lines may be perforated lines of weakness. Preferably, the perforations forming the perforated lines of weakness are of equal length.

Preferably, the bags are arranged on the roll such that the open end of one bag is located adjacent to the open end of an adjacent bag.

Preferably, the material is folded before forming a roll. Preferably, the material is centre folded, that is to say the material is folded along its longitudinal axis.

The material may be 'c' folded. 'c' folded means that the ends extending along the length of the material are folded towards the longitudinal axis of the material, and thereby form a c-shape when viewed from an end of the material.

According to a third aspect of the present invention, there is provided a method of providing a roll of bags, the method comprising the steps of providing a tube of material, heat sealing across the width of the material to form a closed end of each bag; creating a respective first weakened line adjacent to each closed end and a respective second weakened line at an open end of each bag to enable one end of each bag to be separated from an adjacent bag, wherein each second weakened line is shaped so that each bag has elongate protrusions extending away from a body of the bag at its open end.

The method may include the step of creating at least one aperture in each elongate protrusion. Preferably, each aperture is created by so as to create a handle.

The step of creating an aperture in the elongate protrusions may be performed by punching.

Preferably, the material is centre folded before creating the second weakened line and, preferably, before punching. Centre folding the material enables a single punch to create two apertures in each elongate protrusion.

Preferably, the method includes the step of c-folding the material so as to reduce the width of the body before converting the material into a roll. In one embodiment, the method includes the step of double c-folding the material.

The method may also include the step of folding the free ends at the centre of the material outwardly to increase the thickness at the edges of the material before converting into a roll.

Figure 2A:
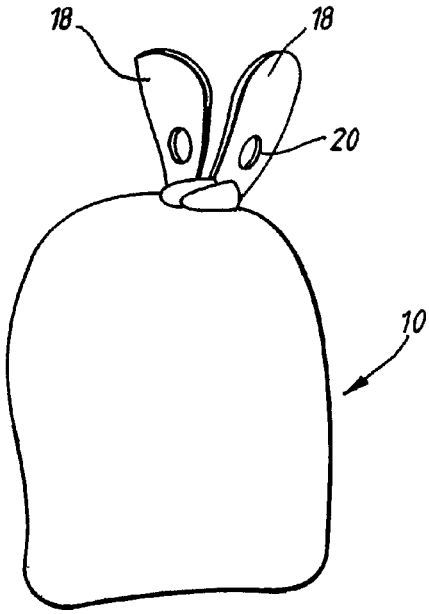
Figure 2B:
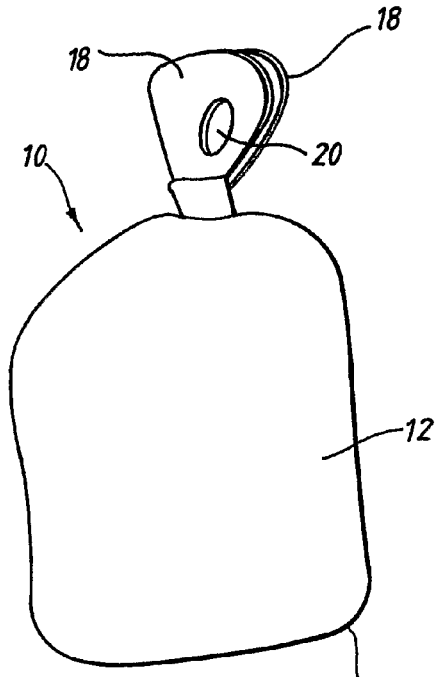
Figure 3:
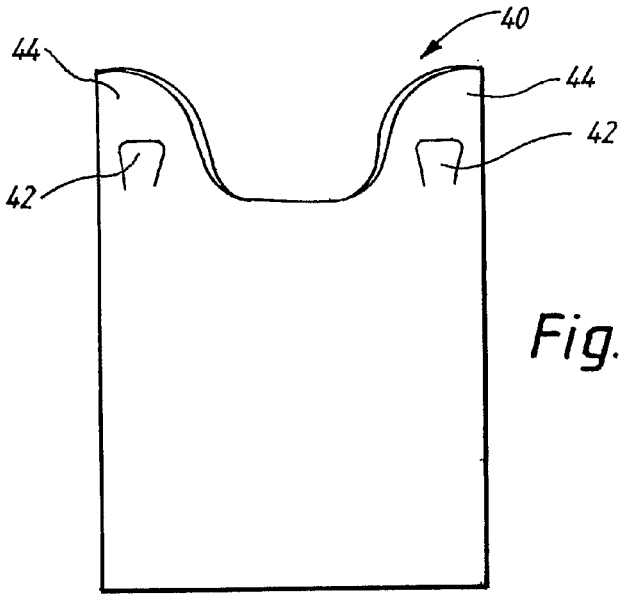
Figure 4A:
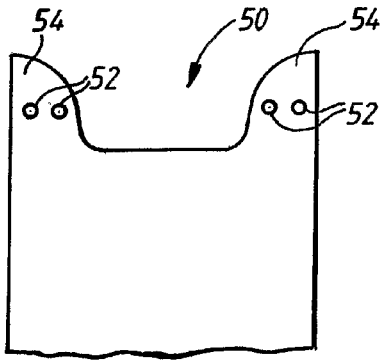
Figure 4B:
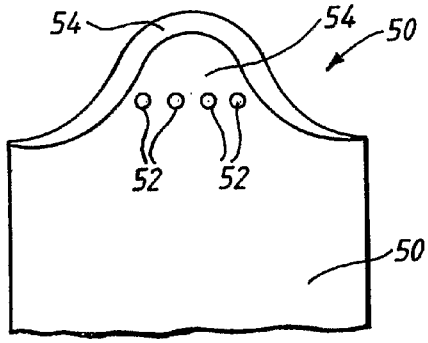
Figure 4C:
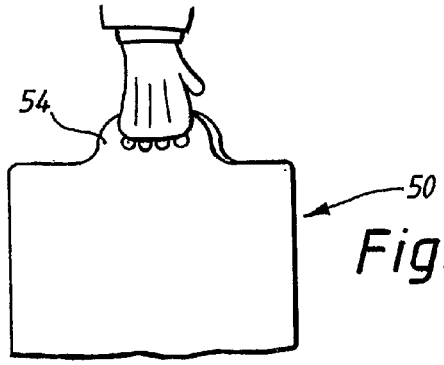
Figure 5A:
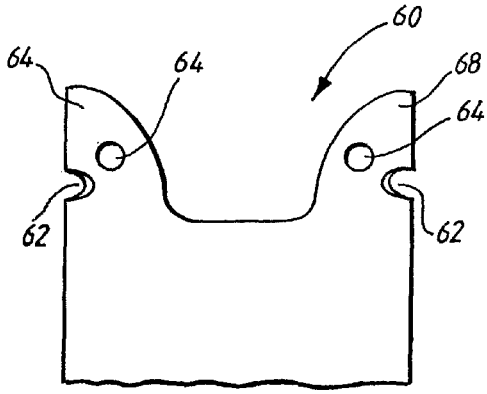
Figure 5B:
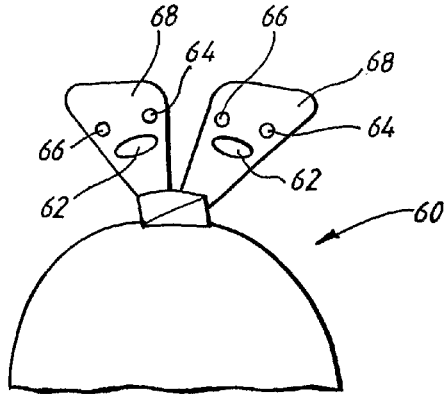
Figure 6A:
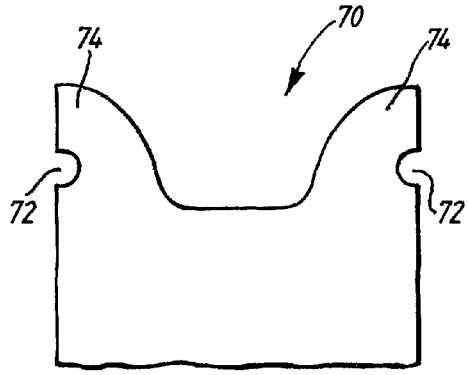
Figure 6B:
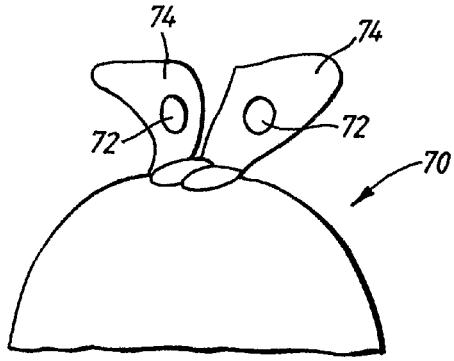
Figure 7:
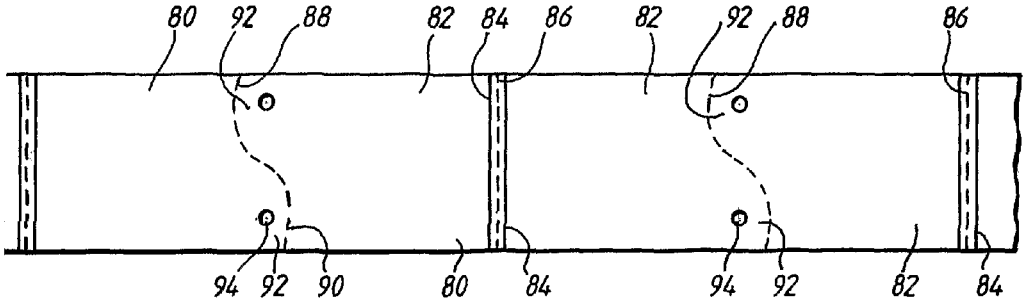

Embodiments of the present invention will now be described with reference to the accompanying drawings in which:

FIG. 1 is a schematic illustration of a bag constructed in accordance with the present invention, the bag having two apertures in each elongate protrusion;

FIGS. 2*a* and 2*b* are schematic illustrations of the bag shown in FIG. 1 having its elongate protrusions knotted together to close a mouth of the bag;

FIG. 3 is a schematic illustration of a modified form of bag constructed in accordance with the present invention, the bag being formed with a partial cut-out in each elongate protrusion;

FIGS. 4*a* to 4*c* are schematic illustrations of a modified form of bag constructed in accordance with the present invention, the bag being formed having four cut-outs in each elongate protrusion;

FIGS. 5*a* and 5*b* are schematic illustrations of a modified form of bag constructed in accordance with the present invention, the bag being formed having three cut-outs in each elongate protrusion;

FIGS. 6*a* and 6*b* are schematic illustrations of a modified form of bag constructed in accordance with the present invention, the bag being formed having a single aperture in each elongate protrusion;

FIG. 7 is a schematic illustration of a length of material defining a plurality of bags constructed in accordance with the present invention.

FIGS. 8*a* to 8*d* are schematic illustrations showing how the material of the bag can be centre folded, 'c' folded, reverse 'c' folded and double 'c' folded.

Figure 9A:
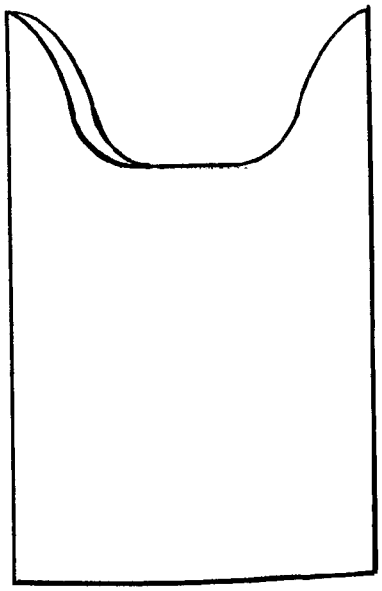
Figure 9B:
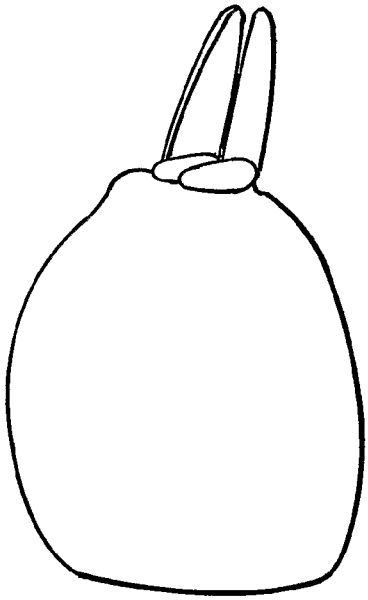

FIGS. 9*a* and 9*b* are schematic illustrations of yet a further modified bag constructed in accordance with the present invention.

Referring to FIG. 1, there is provided a plastic bag 10 for handling refuse such as domestic waste. The bag 10 comprises an elongate body 12 having a closed end, defining a bottom 14 of the bag, the closed end being created by heat sealing across the width of the body of the bag. At an opposite end of the bag 10 an opening defines a mouth 16 of the bag. The bag 10 also includes a single pair of integral elongate protrusions 18 that extend away from the body 12, each elongate protrusion including two apertures or holes 20 created by removing a portion of material enabling the elongate protrusions to act as handles. The bag 10 is made from a thermoplastics material such as polyethylene.

The apertures 20 provided in the elongate protrusions 18 form a closed handle, that is to say an opening, surrounded by material, into which a user can place a hand so as to lift or carry the bag 10. Providing a closed handle provides the advantage that a user does not merely relying on gripping around the protrusions or ears to carry the bag 10, which can result in the protrusions or "ears" slipping out of the user's hand, especially when the bag is heavily laden.

The apertures 20 of the bag 10 are located in each elongate protrusion 18 at a position which is relatively close to the body 12 of the bag. Positioning the apertures 20 in such a location maximises the material above each of the apertures, and therefore ensures maximum strength is provided when the protrusions 18 are used as handles for lifting and/or carrying the bag 10.

The apertures 20 are formed by punching cut-outs in the material. The cut-outs can be completely removed by the punch as it creates the cut-outs. However, the punch may create cut-outs each of which is loosely coupled to the respective protrusion by small webs.

The protrusions 18 are arranged to be of a sufficient length to enable them to be tied or manipulated, as illustrated in FIGS. 2*a* and 2*b*. That is to say, the protrusions 18 can be crossed over and pulled together to form a hitch so as to close the mouth 16 of the bag 10, and are of sufficient length to enable the protrusions to be tied in a knot. After the knot has been tied, the protrusions 18 can be arranged so that the apertures 20 in the protrusions are coincident with one another. The bag 10 can then be lifted and carried by the user by inserting their fingers, or hand, into the apertures.

Referring now to FIG. 3, a modified bag 40 is provided with a respective cut-out 42 in each of a pair of elongate protrusions 44. Each cut-out 42 is arranged so that a portion of that cut-out is not weakened or cut, and therefore remains firmly connected to, or integral with, its protrusion 44. The uncut or connecting portions are arranged to be portions of the cut-outs 42 closest to the body of the bag 40 forming an "upside-down cut-out". This feature reduces the possibility of tear propagation when a loaded bag 40 is lifted.

Referring to FIG. 4, in another modified form a bag 50 is provided with four apertures 52 in each of two elongate protrusions 54 of the bag. The protrusions 54 are arranged to receive the fingers of a user.

Referring to FIGS. 5*a* and 5*b*, in another modified form a bag 60 may be arranged to have three apertures 62, 64 and 66 provided in each of two elongate protrusions 68, wherein each aperture 62 is spaced longitudinally along the bag 60 with respect to the other apertures 64, 66 in each protrusion 68.

Referring to FIGS. 6*a* and 6*b*, in yet a further modified form a bag 70 is provided with a single aperture 72 in each of the two protrusions 74.

Referring now to FIG. 7, a plurality of bags 80 is provided in an elongate length of thermoplastics material 82 which can be folded, and subsequently converted into a roll. Each of the bags 80 is arranged so as to be separable from an adjacent bag.

The material 82 is in the form of a tube which can be extruded in this form so as to be seamless. However, the tube may be formed from a single sheet, which is folded along its length so that its free-ends overlap. The free-ends are then heat sealed so as to form a tube. Alternately, two elongate sheets may be superimposed and then heat sealed along the length of both sheets to form a tube.

The bags 80 are arranged in a "head to head" style on the material 82. This means that the bags 80 are arranged such that an open end 88 of one bag is located adjacent to the open end of a next bag, and subsequently, the closed end 84 of one bag is adjacent to a closed end of another bag, as illustrated in FIG. 7. Having the bags 80 arranged in a "head to head" style ensures no waste.

The material 82 is heat sealed across its width so as to form each closed end 84 so as define a bottom of each bag 80. In addition, a first perforated line of weakness 86 is created so as to be located adjacent to each closed end 84, thereby allowing respective bags 80 either side of each first perforated line 86 to be separated from one another when required. Due to the layout of the bags 80 on the material 82, each first perforated line of weakness 86 is located between the closed ends 84 of two adjacent bags.

Each open end 88 is defined in the material 82 by a respective second perforated line of weakness 90 the length of each perforation being equal. The shape of the second perforated line 90 is such that it defines the shape of each elongate protrusion 92. The second perforated line 90 is arranged such that each of the protrusions 92 is slightly curved in shape. However, it will be appreciated that the protrusions can be made in any one of a number of shapes.

Figure 8A:
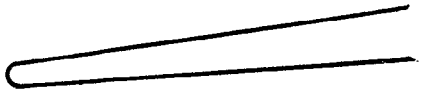

The process of defining each of the bags 80 on the material 82 includes the step of centre folding the material along its longitudinal axis. Prior to centre folding the material is heat sealed to form closed ends 84 of each bag and the perforated lines of weakness 86 are created adjacent to the closed end of each bag. After the material 82 is centre folded, apertures 94 are created by punching one or more holes in each of the protrusions 92. The advantage of centre folding the material 82 is that it reduces the number of punches required, for example, a single punch can be used to create two apertures in each protrusion when the material is centre folded. The second perforated lines 90 which define the open ends of each bag 80 can also be made after the material 82 has been centre folded. FIGS. 7 and 8*a* illustrate the material in a centre folded arrangement.

Figure 8B:
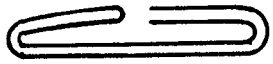
Figure 8C:
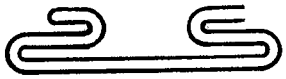
Figure 8D:
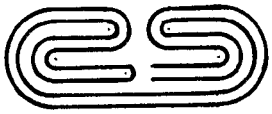

Referring now to FIGS. 8*b*, 8*c* and 8*d*, before converting the material 82 into a roll, the material can be 'c' folded by bringing the edges of the material towards the longitudinal axis of the centre folded material as illustrated in FIG. 8*b*. This step reduces the width of the bag before it is converted into a roll. The material 82 may also include the step of folding the free ends at the centre of the bag outwardly, as illustrated in FIG. 8*c*, so that the material is reverse 'c' folded. Alternatively, the process may include the step of folding the edges of the material towards the longitudinal axis of the centre of the folded material after the first 'c' fold, as illustrated in FIG. 8*d*, so that the material is double 'c' folded.

It will be appreciated that various modifications may be made to the present invention without departing from the scope thereof. For example, the bags may not include any apertures in the pair of elongate protrusions, thereby resulting in a bag as illustrated in FIGS. 9*a* and 9*b* of the drawings. In this embodiment the elongate protrusions form the handle by which the bag may be carried.

It will be appreciated that the bags are suitable for use as bin liners for storing refuse and as food storage bags. However, the use of the bags is not so limited, and other uses are contemplated, for example, storing clothes or various raw materials prior to production, toys, packaging etc. The person skilled in the art would modify the dimensions of the bag accordingly to suit the particular intended use.

The invention claimed is:

1. A refuse bag comprising an elongate body having a closed end defining a bottom of the bag and an open end defining a mouth of the bag, wherein the body is provided with a pair of integral elongate protrusions that extend away from the body, the pair of elongate protrusions being constructed and arranged such that they can be tied together in a double knot to close the mouth of the bag, wherein each protrusion is provided with a plurality of apertures formed therein, and each protrusion has a proximal end proximate the body of the bag and an opposite distal end, and wherein each aperture is located in a portion of the respective protrusion closer to the proximal end than to the distal end of the respective protrusion, wherein after the protrusions have been tied in a double knot, the protrusions can be arranged so that the apertures in the protrusions are coincident with one another, and wherein each aperture is created so as to provide a handle and is sized to allow the digits of a hand to be inserted into the aperture.

2. A bag as claimed in claim 1, wherein each aperture is defined by a cut-out.

3. A bag as claimed in claim 1, wherein each aperture is defined by an "upside-down cut-out".

4. A bag as claimed in claim 1, wherein the bag is made from a thermoplastics material such as polyethylene.

5. A roll of material defining a plurality of bags, each bag being a refuse bag in accordance with claim 1, and each bag being formed so as to be separable from the roll.

6. A roll as claimed in claim 5, wherein each aperture is defined by a cut-out.

7. A roll as claimed in claim 5, wherein each aperture is defined by an "upside-down cut-out".

8. A roll as claimed in claim 5, wherein each aperture is formed by removal of material from the roll.

9. A roll as claimed in claim 5, wherein the roll of material is provided with a respective first weakened line adjacent to the closed end of each bag to enable that bag to be separated from the next bag on the roll and an open end of each bag is provided with the second weakened line defining elongate protrusions extending away from the body of that bag to enable that bag to be separated from the next bag on the roll.

10. A roll according to claim 9, wherein the first and second weakened lines are perforated lines of weakness.

11. A roll according to claim 10, wherein the perforations forming the perforated lines of weakness are of equal length.

12. A roll as claimed in claim 5, wherein the bags are arranged on the rolls such that the open end of one bag is located adjacent to the open end of an adjacent bag.

13. A roll according to claim 5, wherein the material is folded before forming a roll.

14. A roll as claimed in claim 5, wherein each aperture is defined by a cut-out portion in such a manner that the cut-out portion remains connected to the associated protrusion.

15. A bag as claimed in claim 1, wherein each aperture is defined by a cut-out portion in such a manner that the cut-out portion remains connected to the associated protrusion.

* * * * *

UNITED STATES PATENT AND TRADEMARK OFFICE

CERTIFICATE OF CORRECTION

PATENT NO. : 8,083,409 B2
APPLICATION NO. : 11/720096
DATED : December 27, 2011
INVENTOR(S) : Gelbard It is certified that error appears in the above-identified patent and that said Letters Patent is hereby corrected as shown below:

Column 1,

Line 12, “male” should read --make--.

Signed and Sealed this
Twenty-sixth Day of March, 2013

Teresa Stanek Rea
*Acting Director of the United States Patent and Trademark Office*